US009157262B2

(12) United States Patent
Lee

(10) Patent No.: US 9,157,262 B2
(45) Date of Patent: Oct. 13, 2015

(54) DOOR HINGE

(71) Applicant: Poong Won Industry Co., Ltd., Gimhae, Kyungnam (KR)

(72) Inventor: June-young Lee, Gimhae (KR)

(73) Assignee: Poong Won Industry Co., Ltd. (KR)

( * ) Notice: Subject to any disclaimer, the term of this patent is extended or adjusted under 35 U.S.C. 154(b) by 0 days.

(21) Appl. No.: 14/093,872

(22) Filed: Dec. 2, 2013

(65) Prior Publication Data

US 2014/0109344 A1 Apr. 24, 2014

Related U.S. Application Data

(63) Continuation of application No. PCT/KR2012/003535, filed on May 4, 2012.

(30) Foreign Application Priority Data

Nov. 16, 2011 (KR) ..... 10-2011-0119228

(51) Int. Cl.
*E05F 1/08* (2006.01)
*E05D 3/12* (2006.01)
(Continued)

(52) U.S. Cl.
CPC *E05D 3/12* (2013.01); *D06F 39/14* (2013.01); *E05F 1/105* (2013.01); *E05Y 2201/638* (2013.01); *E05Y 2900/312* (2013.01); *Y10T 16/5388* (2015.01)

(58) Field of Classification Search
CPC ..... E05F 1/1246; E05F 1/1253; E05F 1/1261; E05F 1/1292; E05F 1/14; E05F 1/12; E05F 3/20; E05Y 2201/21; E05Y 2201/264; E05Y 2201/416; E05Y 2201/47; E05Y 2201/471; E05Y 2900/20; E05Y 2900/30; E05Y 2900/302; E05Y 2900/304; E05Y 2900/306; E05Y 2900/308; E05Y 2900/31; E05Y 2900/312
USPC ..... 16/286, 289, 290, 292, 321, 322, 306; 49/386, 387, 389, 398, 402; 126/190, 126/191, 192, 194; 312/323, 325, 326, 327
See application file for complete search history.

(56) References Cited

U.S. PATENT DOCUMENTS 4,658,473 A * 4/1987 Schema ..... 16/290
6,637,319 B1 * 10/2003 Vanini et al. ..... 99/467
(Continued)

FOREIGN PATENT DOCUMENTS

DE 3140039 A1 * 4/1983
DE 4105274 A * 11/1991
(Continued)

*Primary Examiner* — Chuck Mah
(74) *Attorney, Agent, or Firm* — Park & Associates IP Law, P.C.

(57) ABSTRACT

A door hinge includes: a fixed board fixed to a door frame; a cover housing fitted to the upper end of the fixed board; an operation frame fixed to a door; an operation cam member rotatably disposed inside the cover housing and axially coupled to the operation frame fixed to the door by a shaft, so that the operation cam member rotates around the shaft according to the rotating operation of the operation frame; a link coupled eccentrically to one side of the operation cam member by a second pin and linearly moving according to the rotating operation of the operation cam member; a slider coupled to the link by a first pin and moving horizontally in forward and backward directions according to the linear movements of the link in the state disposed inside the cover housing; and a spring fitted to the outer circumferential surface of the slider to elastically support the closing operation of the door.

6 Claims, 8 Drawing Sheets

(51) Int. Cl.
*E05F 1/10* (2006.01)
*D06F 39/14* (2006.01)

(56) References Cited

U.S. PATENT DOCUMENTS

| | | | | |
|---|---|---|---|---|
| 7,096,535 | B2 * | 8/2006 | Lin | 16/287 |
| 7,610,656 | B2 * | 11/2009 | Vanini | 16/286 |
| 2006/0053589 | A1 * | 3/2006 | Vanini | 16/286 |
| 2009/0064458 | A1 * | 3/2009 | Vanini | 16/304 |
| 2010/0148646 | A1 * | 6/2010 | Bettinzoli | 312/326 |
| 2010/0236021 | A1 * | 9/2010 | Sir Louis | 16/303 |
| 2010/0281650 | A1 * | 11/2010 | Kleemann et al. | 16/64 |

FOREIGN PATENT DOCUMENTS

| | | | |
|---|---|---|---|
| DE | 19538824 | A1 * | 5/1996 |
| EP | 589853 | A1 * | 3/1994 |

* cited by examiner

DOOR HINGE

REFERENCE TO RELATED APPLICATIONS

This is a continuation of pending International Patent Application PCT/KR2012/003535 filed on May 4, 2012, which designates the United States and claims priority of Korean Patent Application No. 10-2011-0119228 filed on Nov. 16, 2011, the entire contents of which are incorporated herein by reference.

FIELD OF THE INVENTION

The present invention relates to a door hinge, and more particularly, to a door hinge configured to more stably close a door.

BACKGROUND OF THE INVENTION

Generally, a top-loading door is open from the bottom side to the top side, and a representative example of the top-loading door is a door for a washing machine. Representatively, the door for the washing machine will be described herein.

Generally, the washing machine conducts a series of washing, rinsing, and dewatering operations automatically by feeding laundry, water, and an appropriate amount of detergent in a washing tub and applying the impacts produced by mechanical water currents to the laundry.

The washing machine has a water storage tank disposed inside a cabinet so as to store water therein and a washing tub disposed rotatably inside the water storage tank. Further, a door frame having hinge holes formed on the side thereof is mounted on top of the cabinet, and a door is mounted on the door frame so as to selectively open and close the washing tub through which the laundry is put from the outside.

On the other hand, door hinges are mounted at both sides of the door so as to perform the opening and closing operations of the door.

However, the conventional door hinges are configured to connect the door and the door frame just by means of pins (one axis), so that upon the closing operation of the door, it is impossible to artificially adjust the closing speed of the door. When the door is closed too strongly, therefore, a user's fingers may be damaged by the door being closed, and further, noise may be generated when the door is closed, which causes many inconveniences in use.

SUMMARY OF THE INVENTION

Accordingly, the present invention has been made in view of the above-mentioned problems occurring in the prior art, and it is an object of the present invention to provide a door hinge that is capable of performing the closing operation of a door stably by means of the tension force of a spring generated during a slider moves according to the rotating operation of an operation cam member.

It is another object of the present invention to provide a door hinge that is capable of damping the closing speed of a door being closed more effectively by means of the formation of a damping member, thus allowing the door to be closed slowly.

To accomplish the above-mentioned objects, according to the present invention, there is provided a door hinge including: a fixed board fixed to a door frame; a cover housing fitted to the upper end of the fixed board; an operation frame fixed to a door; an operation cam member rotatably disposed inside the cover housing and axially coupled to the operation frame fixed to the door by means of a shaft, so that the operation cam member rotates around the shaft according to the rotating operation of the operation frame; a link coupled eccentrically to one side of the operation cam member by means of a second pin and linearly moving according to the rotating operation of the operation cam member; a slider coupled to the link by means of a first pin and moving horizontally in forward and backward directions according to the linear movements of the link in the state of being disposed inside the cover housing; and a spring fitted to the outer circumferential surface of the slider and compressed according to the horizontal movements of the slider to elastically support the closing operation of the door.

According to an embodiment of the present invention, preferably, the door hinge further includes a damping member mounted inside the fixed board to damp the closing speed of the door.

According to an embodiment of the present invention, preferably, the damping member includes: a cylinder fixedly disposed inside the fixed board; a rod connected to the cylinder; and a holder coupled to the rod in such a manner as to be brought selectively into contact with a locking protrusion formed on the underside end of the slider.

DETAILED DESCRIPTION OF THE INVENTION

According to the present invention, there is provided a door hinge including: a fixed board fixed to a door frame; a cover housing fitted to the upper end of the fixed board; an operation frame fixed to a door; an operation cam member rotatably disposed inside the cover housing and axially coupled to the operation frame fixed to the door by means of a shaft, so that the operation cam member rotates about the shaft together with the operation frame in response to the rotating operation of the door; a link coupled eccentrically to one side of the operation cam member by means of a second pin and linearly moving according to the rotating operation of the operation cam member; a slider coupled to the link by means of a first pin and moving horizontally in forward and backward directions according to the linear movements of the link in the state of being disposed inside the cover housing; and a spring fitted to the outer circumferential surface of the slider and compressed according to the horizontal movements of the slider to elastically support the closing operation of the door.

Hereinafter, an explanation on a door hinge according to preferred embodiments of the present invention will be in detail given with reference to the attached drawings. In the detailed description, representative embodiments will be suggested to accomplish the above-mentioned technical solution of the present invention. Further, other embodiments of the present invention will be just explained in the description of the configuration of the door hinge of the present invention.

Figure 1:
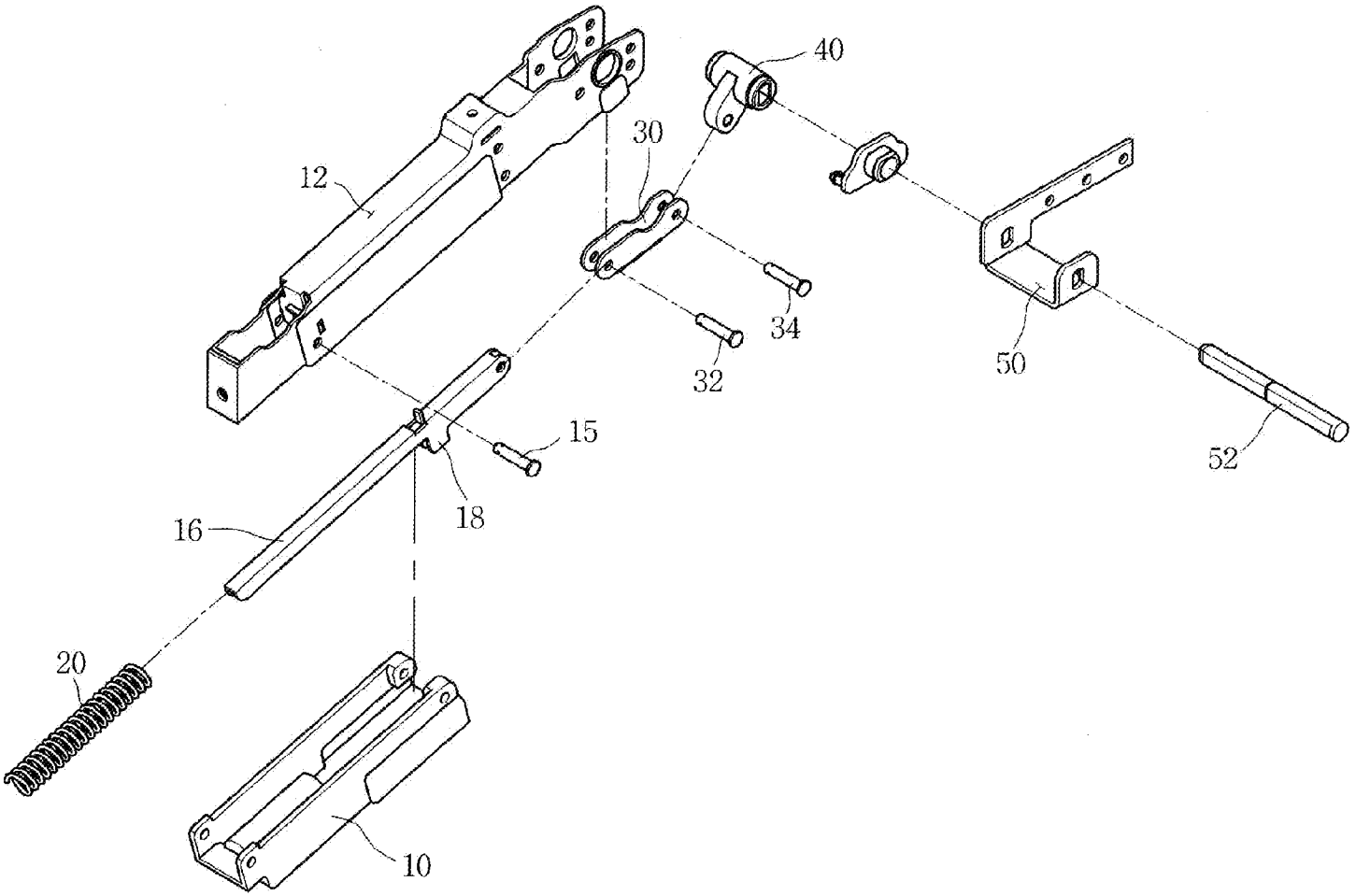
FIG. 1 is an exploded perspective view showing a door hinge according to a first embodiment of the present invention.
Figure 2:
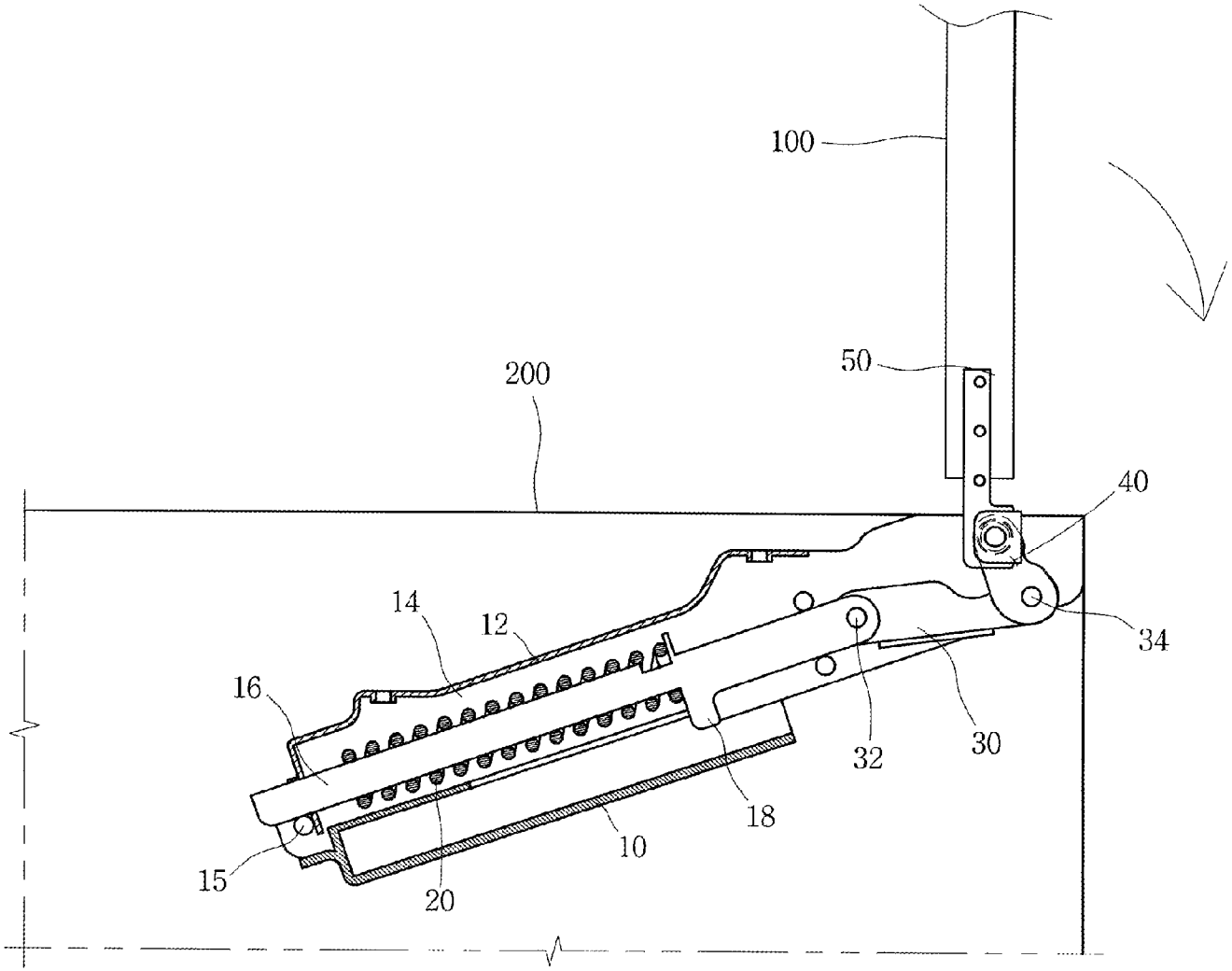
FIG. 2 is a sectional view showing the door hinge of FIG. 1.

FIG. 1 is an exploded perspective view showing a door hinge according to a first embodiment of the present invention, and FIG. 2 is a sectional view showing the door hinge of FIG. 1.

As shown in FIGS. 1 and 2, a door hinge according to a first embodiment of the present invention is used for a top-loading door configured to open a door from the bottom side to the top side, which is generally used to open/close a door disposed on the top end of a washing machine.

That is, the door hinge is a device connecting a door 100 of a washing machine with a door frame 200 so that the door 100 is open and closed, and the door hinge largely includes a fixed board 10, a cover housing 12, and an operation frame 50.

The fixed board 10 is fixed to the door frame 200 of the washing machine in such a manner as to be open on the upper end thereof.

The cover housing 12 is fitted to the open upper end of the fixed board 10 and has a space portion 14 formed at the inside thereof, into which means for elastically controlling the rotation of the operation frame 50 is located.

The means located inside the space portion 14 of the cover housing 12 includes a slider 16, a spring 20, a link 30 and an operation cam member 40.

The slider 16 is fittedly disposed inside the cover housing 12 in such a manner as to move horizontally in forward and backward directions and has one end connected to one end of the link 30 by means of a first pin 32. The slider 16 has a locking protrusion 18 formed on the underside end thereof in such a manner as to lock the spring 20 thereonto.

The spring 20 is fitted to the outer circumferential surface of the slider 16 and has one end locked onto a locking pin 15 passed through the cover housing 12 and the other end locked onto the locking protrusion 18 protrudedly formed on the underside end of the slider 16, so that the spring 20 is elastically compressed by the horizontal movements of the slider 16 to exert a tension force elastically controlling the rotation (that is, since the operation frame 50 is coupled to the door 100, the rotation of the operation frame 50 becomes the tension force controlling the closing operation of the door 100) of the operation frame 50.

The link 30 is coupled at one end thereof to the slider 16 by means of the first pin 32 and coupled eccentrically at the other end thereof to the operation cam member 40 by means of a second pin 34, so that the link 30 pushes the slider 16 according to the rotation of the operation cam member 40 to allow the slider 16 to move horizontally.

The operation cam member 40 is fitted to the space portion 14 of the cover housing 12 and axially coupled to the operation frame 50 as will be described below by means of a shaft 52, so that the operation cam member 40 rotates about the shaft 52 together with the operation frame 50 in response to the rotation of the door. Further, the operation cam member 40 is coupled eccentrically at one side thereof to the link 30 by means of the second pin 34.

If the operation frame 50 coupled to the door 100 rotates according to the closing operation of the door 100, the operation cam member 40 rotates about the shaft 52, and at this time, since the link 30 is coupled eccentrically to the operation cam member 40 by means of the second pin 34, the link 30 linearly moves according to the rotation of the operation cam member 40 to push the slider 16 connected thereto by means of the first pin 32, thus horizontally moving the slider 16.

At this time, the spring 20, which is fitted to the outer circumferential surface of the slider 16, becomes compressed according to the movement of the slider 16 to exert a tension force (compressing force), and the tension force generated from the spring 20 serves as a force supporting the door 100 being closed, thereby resisting the load of the door 100, so that the door 100 can be slowly closed, without being abruptly closed.

During the closing operation, on the other hand, if the door 100 is closed to an angle of about 15° with respect to a horizontal line, the load of the door 100 is applied larger than the compressing force of the spring 20, and accordingly, when the door 100 is closed to the angle of about 15°, the door 100 can be closed at a rapider speed since it is rarely under the influence of the compressing force of the spring 20 (In this case, a rapider speed means the speed lower than that at which the door is closed normally in a state where the spring 20 is not mounted).

One end of the operation frame 50 is coupled to the shaft 52 of the operation cam member 40 and the other end thereof is coupled to the door 100, so that the operation frame 50 rotates according to the opening and closing operations of the door 100 to rotate the operation cam member 40 coupled thereto by means of the shaft 52.

Hereinafter, an explanation on the operation procedure of the door hinge according to the first embodiment of the present invention will be given with reference to FIGS. 3 and 4.

Figure 3:
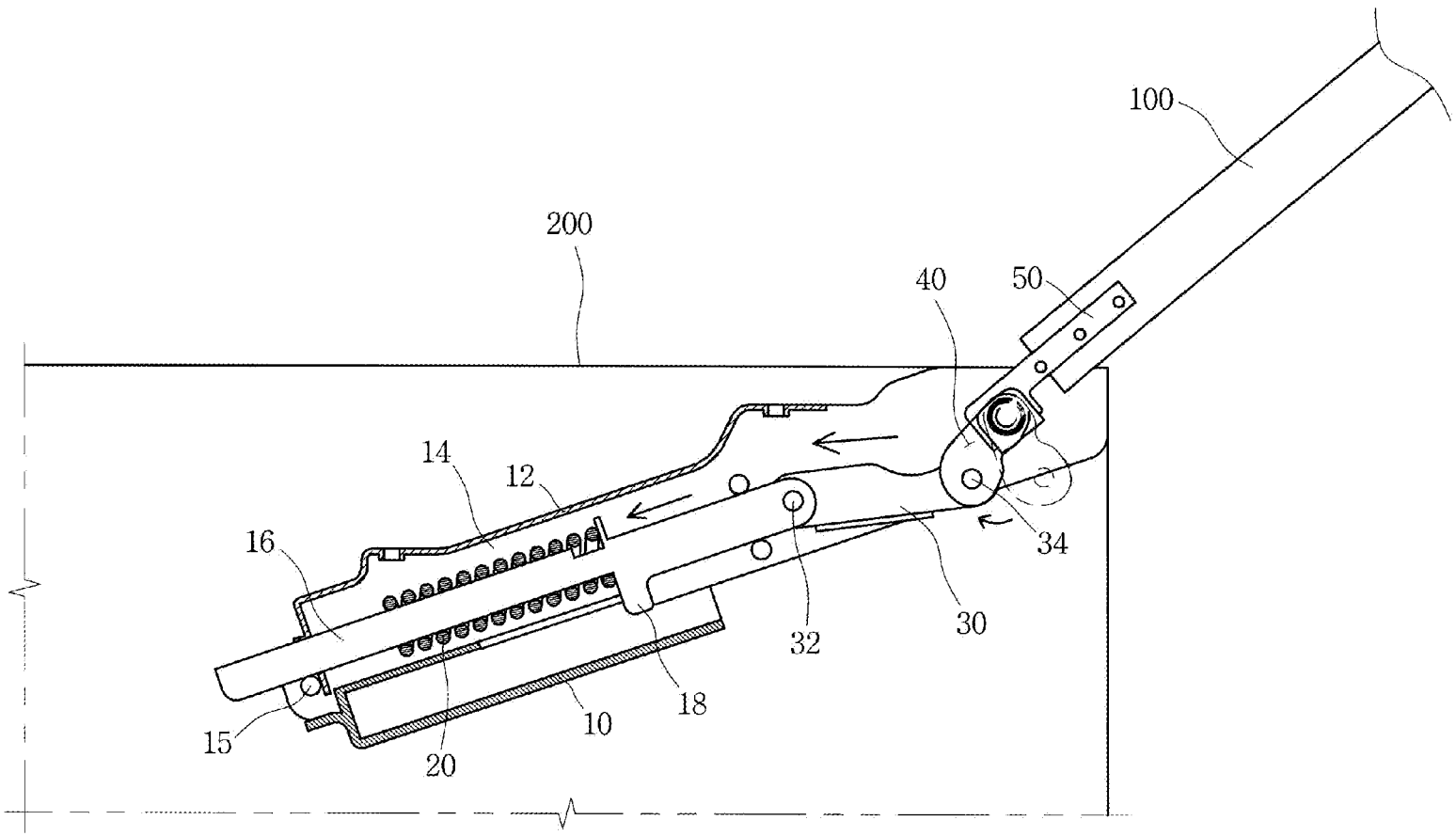
FIGS. 3 and 4 are sectional views showing the sequential operating states of the door hinge of FIG. 1 according to door closing.

FIG. 3 shows the state where the door 100 being in the state of being open starts to be closed. As shown in FIG. 3, if the door 100 starts to be closed, the operation frame 50 coupled to the door 100 rotates, and accordingly, the operation cam member 40 coupled to the operation frame 50 by means of the shaft 52 rotates according to the rotating operation of the operation frame 50.

If the operation cam member 40 rotates, the link 30 coupled eccentrically to one side of the operation cam member 40 by means of the second pin 34 pushes the slider 16 connected thereto by means of the first pin 32 according to the rotating operation of the operation cam member 40, and accordingly, the spring 20, which is fitted to the outer circumferential surface of the slider 16 and locked onto the locking protrusion 18 of the slider 16, is elastically compressed by the horizontal movements of the slider 16 to exert a given tension force. At this time, the tension force generated from the spring 20 serves as a force supporting the door 100 being closed, thereby resisting the load of the door 100, so that the door 100 can be slowly closed, without being abruptly closed.

Figure 4:
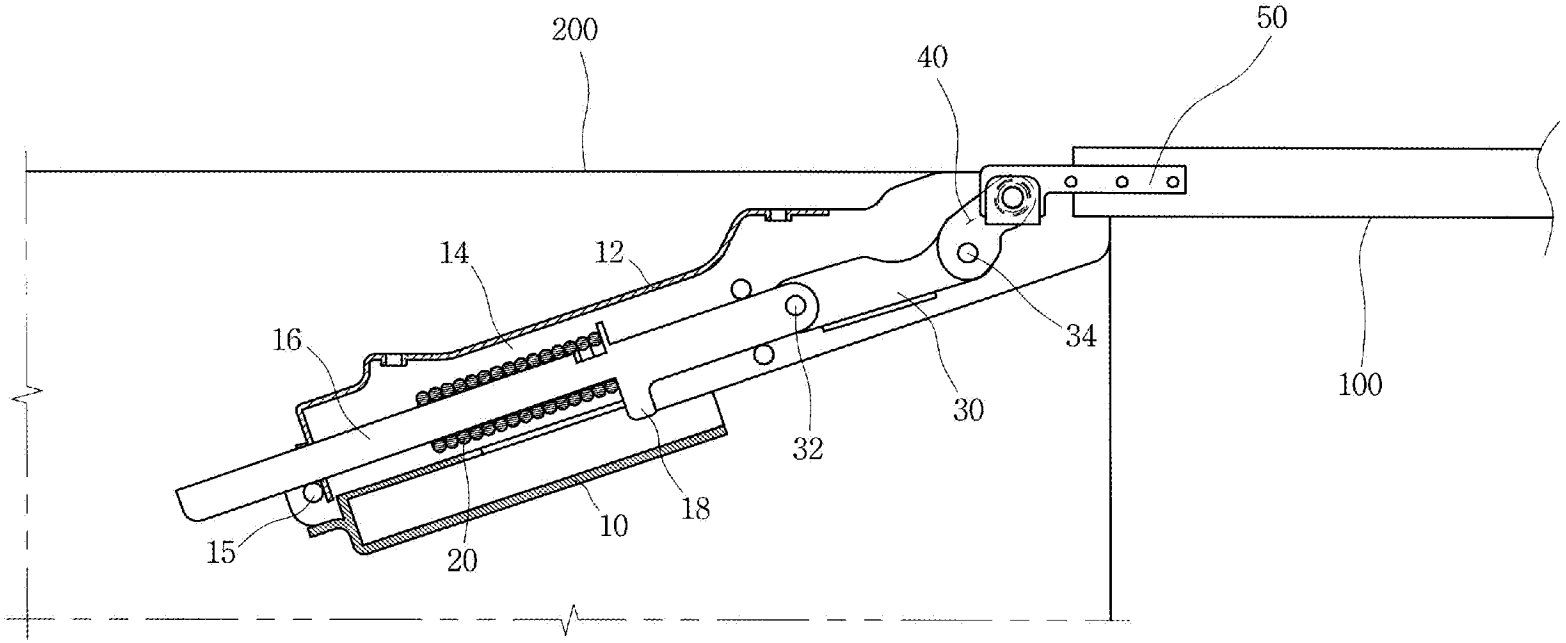

Next, during the door 100 is slowly closed through the tension force of the spring 20, as shown in FIG. 4, if the door 100 is closed to an angle of about 15° with respect to a horizontal line, the load of the door 100 at this moment is applied larger than the compressing force of the spring 20, so that the door 100 can be closed at a rapider speed since it is rarely under the influence of the compressing force of the spring 20.

Figure 5:
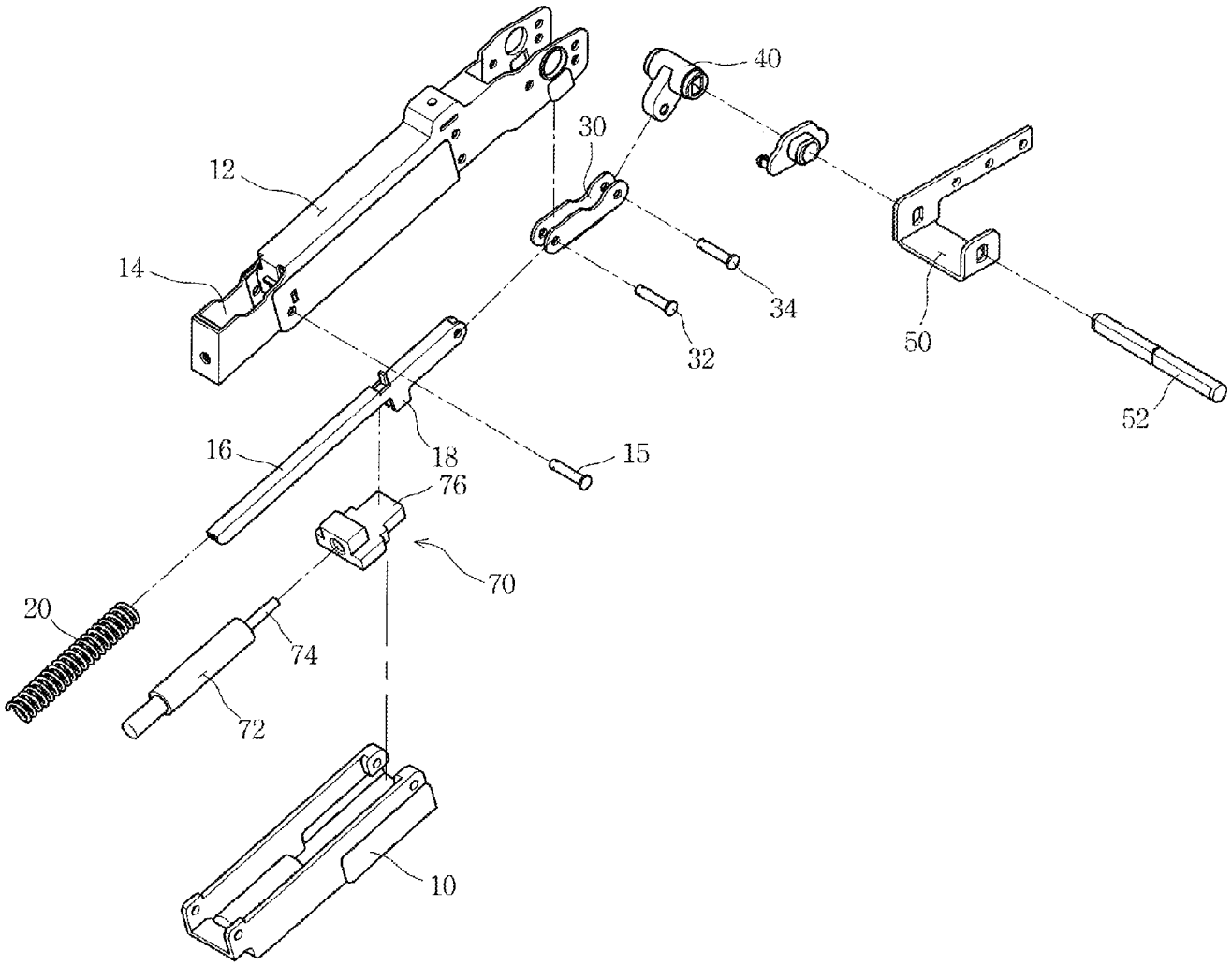
FIG. 5 is an exploded perspective view showing a door hinge according to a second embodiment of the present invention.
Figure 6:
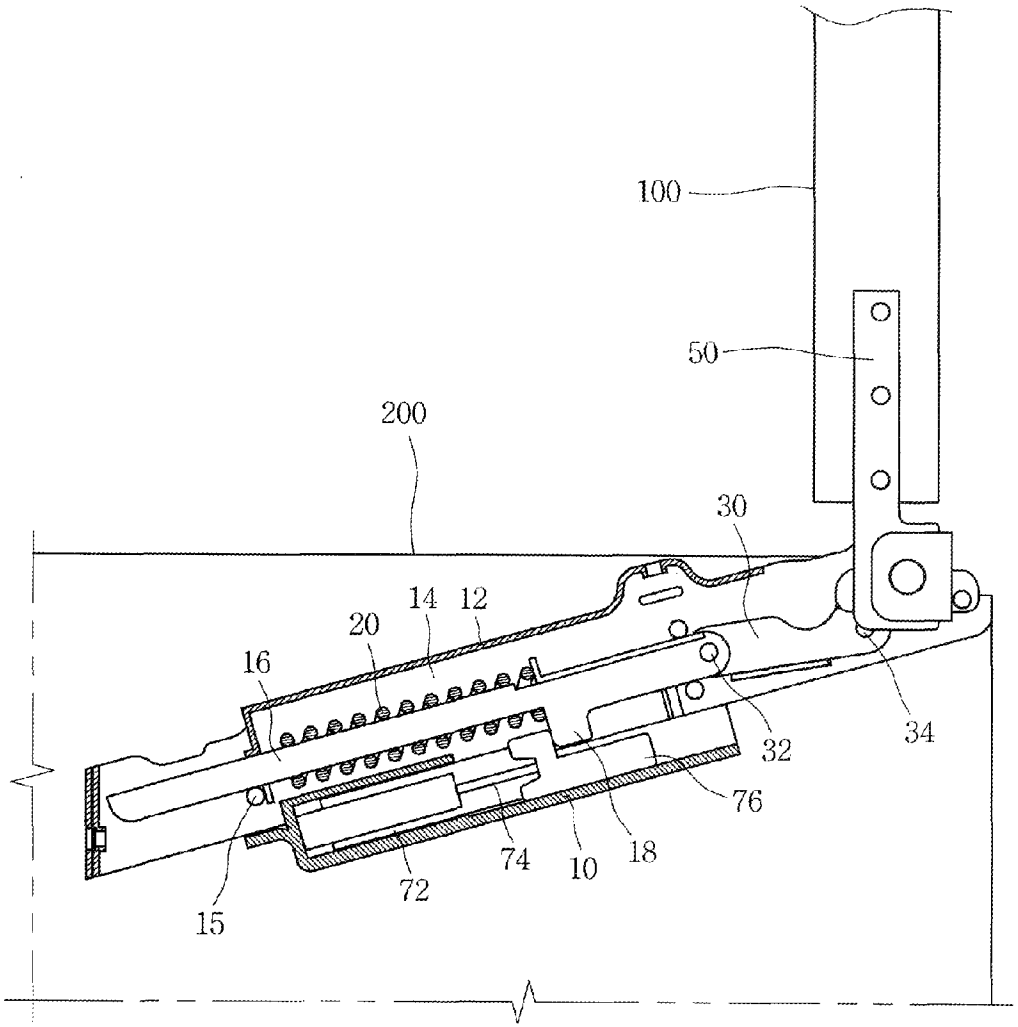
FIG. 6 is a sectional view showing the door hinge of FIG. 5.

FIG. 5 is an exploded perspective view showing a door hinge according to a second embodiment of the present invention, and FIG. 6 is a sectional view showing the door hinge of FIG. 5.

As shown in FIGS. 5 and 6, a door hinge according to a second embodiment of the present invention has the same configuration as that according to the first embodiment of the present invention, and preferably, the door hinge includes: a fixed board 10 fixed to a door frame 200; a cover housing 12 fitted to the upper end of the fixed board 10; an operation frame 50 fixed to a door 100; an operation cam member 40 rotatably disposed within the cover housing 12 and axially coupled to the operation frame 50 fixed to the door 100 by means of a shaft 52, so that the operation cam member 40 rotates around the shaft 52 according to the rotating operation of the operation frame 50; a link 30 coupled eccentrically to one side of the operation cam member 40 by means of a second pin 34 and linearly moving according to the rotating operation of the operation cam member 40; a slider 16 coupled to the link 30 by means of a first pin 32 and moving horizontally in forward and backward directions according to the linear movements of the link 30 in the state of being disposed inside the cover housing 12; a spring 20 fitted to the outer circumferential surface of the slider 16 and compressed according to the horizontal movements of the slider 16 to elastically support the closing operation of the door 100; and a damping member 70 mounted at the interior of the fixed board 10.

The damping member 70 is means for effectively damping the closing speed of the door 100, in addition to the tension force applied from the spring 20.

The damping member 70 includes a cylinder 72 fixedly disposed inside the fixed board 10, a rod 74 connected to the cylinder 72, and a holder 76 coupled to the rod 74 and locked to the locking protrusion 18 of the slider 16.

If the door 100 is closed to a given angle during the closing, the locking protrusion 18 of the slider 16 is brought into contact with the holder 76 of the damping member 70, and in this state, while the door 100 is being continuously closed, the slider 16 moves to push the holder 76. In this process, the rod 74 coupled to the holder 76 is slowly pushed to allow the closing speed of the door 100 to be damped. At this time, damping means is disposed inside the cylinder 72, and preferably, the damping means includes a piston connected to the rod 74 and a spring elastically supporting the piston, so that the rod 74 can be slowly pushed through the damping means.

Hereinafter, an explanation on the operation procedure of the door hinge according to the second embodiment of the present invention will be given with reference to FIGS. 7 and 8.

Figure 7:
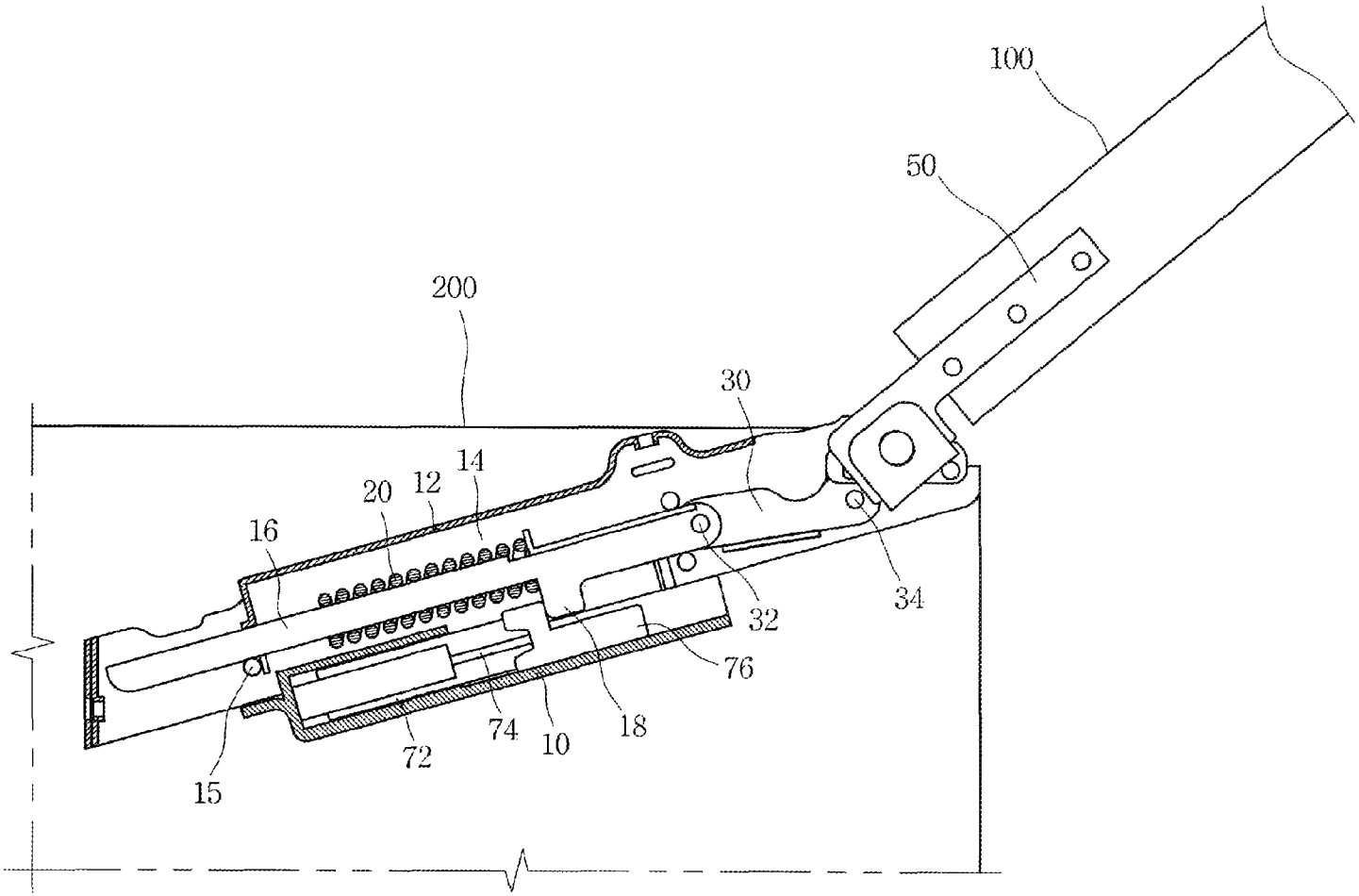
FIGS. 7 and 8 are sectional views showing the sequential operating states of the door hinge of FIG. 5 according to door closing.
Figure 8:
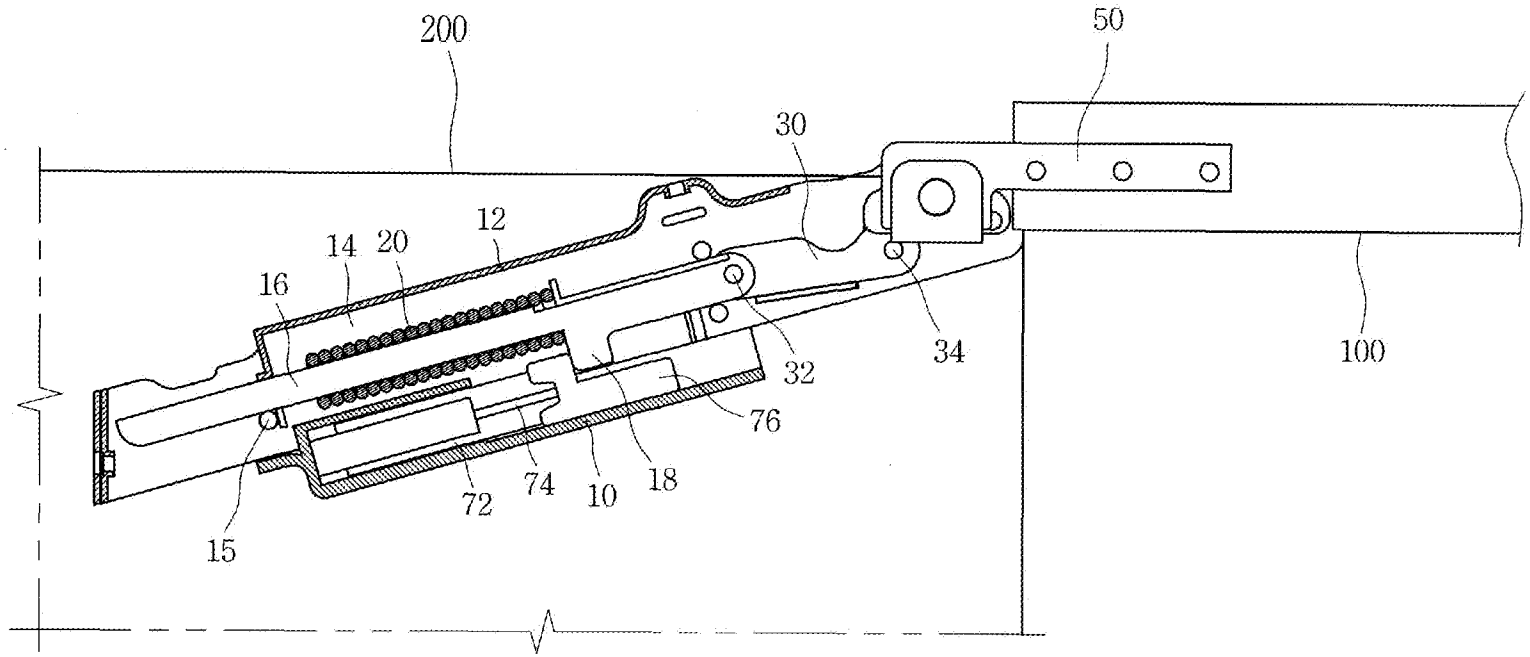

FIG. 7 shows the state where the door 100 being in the state of being open starts to be closed. As shown in FIG. 7, if the door 100 starts to be closed, the operation frame 50 coupled to the door 100 rotates, and accordingly, the operation cam member 40 coupled to the operation frame 50 by means of the shaft 52 rotates according to the rotating operation of the operation frame 50.

If the operation cam member 40 rotates, the link 30 coupled eccentrically to one side of the operation cam member 40 by means of the second pin 34 linearly moves to push the slider 16 connected thereto by means of the first pin 32 according to the rotating operation of the operation cam member 40, and accordingly, the spring 20, which is fitted to the outer circumferential surface of the slider 16 and locked onto the locking protrusion 18 of the slider 16, is elastically compressed by the horizontal movements of the slider 16 to exert a given tension force. At this time, the tension force generated from the spring 20 serves as a force for supporting the door 100 being closed, thereby resisting the load of the door 100, so that the door 100 can be slowly closed, without being abruptly closed.

Next, during the door 100 is slowly closed through the tension force of the spring 20, if the door 100 is closed to an angle of more than a given angle, the locking protrusion 18 of the slider 16 is brought into contact with the holder 76 of the damping member 70, and in this state, while the door 100 is being continuously closed, the slider 16 moves to push the holder 76. In this process, the rod 74 coupled to the holder 76 is slowly pushed toward the interior of the cylinder 72 through the damping means mounted inside the cylinder 72, thus damping the closing speed of the door 100. That is, the damping member 70 as well as the tension force of the spring 20 serve to effectively damp the closing speed of the door 100.

According to the present invention, the closing operation of the door can be stably performed by means of the tension force of the spring generated during the slider moves according to the rotating operation of the operation cam member, and further, the closing speed of the door being closed can be more effectively damped by means of the formation of the damping member, thus allowing the door to be closed in more gentle and stable manners.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A door hinge for a top-loading appliance having a door disposed at an upper side of the appliance, the door hinge comprising:

a fixed board configured to fix to a door frame;

a cover housing fitted to the fixed board;

an operation frame configured to fix to a door of the appliance;

an operation cam member rotatably disposed inside the cover housing and coupled to the operation frame by means of a shaft, so that the operation cam member rotates about the axis of the shaft together with the operation frame in response to the rotating operation of the door;

a link coupled to one side of the operation cam member by means of a pin and linearly moving in response to the rotating operation of the operation cam member;

a slider coupled to the link by means of a pin and moving linearly in forward and backward directions in response to the linear movements of the link while being disposed inside the cover housing, the slider configured to move in the backward direction away from the operation cam member as the door closes from a generally-vertical open position to a generally-horizontal close position, and in the forward direction toward the operation cam member as the door opens from the generally-horizontal close position to the generally-vertical open position; and a spring fitted to the outer circumferential surface of the slider, the spring configured to be compressed during an entire closing stroke of the door from the generally-vertical open position to the generally-horizontal close position of the door, in response to the linear movement of the slider in the backward direction away from the operation cam member to apply an elastic spring force to the door to close the door slowly during the closing operation of the door.

2. The door hinge according to claim 1, further comprising a damping member mounted to the fixed board and coupled to the slider to damp the closing speed of the door.

3. The door hinge according to claim 2, wherein the slider includes a locking protrusion at an underside portion of the slider, wherein the damping member comprises:

a cylinder disposed inside the fixed board; and a rod extending linearly from and reciprocally coupled to the cylinder for activating a damping operation.

4. The door hinge according to claim 3, wherein the damping member further comprises a contact disposed below the slider and moveable in an axial direction of the cylinder, the contact having a shoulder configured to contact with the locking protrusion of the slider to activate the damping operation.

5. A door hinge for a top-loading appliance having a door disposed at an upper side of the appliance, the door hinge comprising:

an operation frame configured to fix to a door of the appliance;

a linkage coupled to the operation frame via a cam member, a distal end of the linkage configured to move linearly in response to the rotating operation of the operation frame by operation of the cam member as the door rotates;

a slider coupled to the linkage and configured to move linearly in forward and backward directions in response to the linear movements of the distal end of the linkage, the slider configured to move in the backward direction away from the cam member as the door closes from a generally-vertical open position to a generally-horizontal close position, and in the forward direction toward the cam member as the door opens from the generally-horizontal close position to the generally-vertical open position, the slider having a locking protrusion disposed at a lower side thereof;

a spring fitted to the outer circumferential surface of the slider, the spring configured to be compressed during an entire closing stroke of the door from the generally-vertical open position to the generally-horizontal close position of the door, in response to the linear movement of the slider in the backward direction away from the cam member to apply an elastic spring force to the door to close the door slowly during the closing operation of the door; and a damper disposed below the slider in parallel relation thereto, the damper configured to contact with the locking protrusion of the slider to activate a damping operation to slow the closing speed of the door.

6. The door hinge according to claim 5, wherein the damper comprises:

a cylinder disposed below the slider in parallel relation thereto;

a rod extending linearly from and reciprocally coupled to the cylinder for providing the damping operation; and a contact disposed below the slider and moveable in an axial direction of the cylinder, the contact having a shoulder configured to contact with the locking protrusion of the slider to activate the damping operation.

* * * * *